US007022949B2

(12) United States Patent
Shukla

(10) Patent No.: US 7,022,949 B2
(45) Date of Patent: Apr. 4, 2006

(54) ELECTRIC COOKING RANGE HAVING MULTIPLE-ZONE POWER CONTROL SYSTEM AND WIPE RESISTANT CONTROL PANEL

(75) Inventor: Sanjay Shukla, Hendersonville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 30 days.

(21) Appl. No.: 10/822,456

(22) Filed: Apr. 12, 2004

(65) Prior Publication Data

US 2004/0256378 A1 Dec. 23, 2004

Related U.S. Application Data

(60) Provisional application No. 60/461,976, filed on Apr. 10, 2003.

(51) Int. Cl.
*H05B 3/02* (2006.01)

(52) U.S. Cl. ..... 219/483; 219/452.11; 219/486; 219/492

(58) Field of Classification Search ..... 219/475–476, 219/482, 486, 489–492, 506–510, 518, 452.11; 73/1.15

See application file for complete search history.

(56) References Cited

U.S. PATENT DOCUMENTS

| | | | | |
|---|---|---|---|---|
| 3,903,395 | A | 9/1975 | Hamstra | |
| 4,052,591 | A | 10/1977 | Sekera, Jr. et al. | |
| 4,849,595 | A | 7/1989 | Fowler | |
| 4,891,497 | A | 1/1990 | Yoshimura | |
| 5,191,190 | A | 3/1993 | Dodson | |
| 5,345,807 | A * | 9/1994 | Butts et al. | 73/1.15 |
| 5,451,746 | A | 9/1995 | Kadwell et al. | |
| 5,662,465 | A | 9/1997 | Kano | |
| 5,710,409 | A | 1/1998 | Schwarzbäcker et al. | |
| 5,786,996 | A | 7/1998 | Vitkus et al. | |
| 5,841,112 | A | 11/1998 | Brooks et al. | |
| 5,947,370 | A | 9/1999 | Rona et al. | |
| 5,981,916 | A | 11/1999 | Griffiths et al. | |
| 6,111,231 | A | 8/2000 | Corson et al. | |
| 6,191,391 | B1 | 2/2001 | Deo et al. | |
| 6,198,080 | B1 | 3/2001 | Rice et al. | |
| 6,712,066 | B1 * | 3/2004 | Atkinson et al. | 219/452.11 |
| 6,717,117 | B1 * | 4/2004 | Blanchard et al. | 219/492 |
| 6,809,301 | B1 * | 10/2004 | McIntyre et al. | 219/506 |
| 2003/0094448 | A1 * | 5/2003 | Shukla et al. | 219/506 |

* cited by examiner

*Primary Examiner*—Tu Hoang
(74) *Attorney, Agent, or Firm*—Pearne & Gordon LLP

(57) ABSTRACT

A multiple-zone power control system for controlling electric heating elements, including a power control unit having multiple control zones, a touch-sensitive function key, and a touch-sensitive on/off key for activating and deactivating one of the control zones. When all of the control zones are deactivated, the touch-sensitive key must be touched for at least a cold start duration in order to activate the designated control zone. Alternatively, the designated control zone is prevented from being activated if the touch-sensitive function key is touched while the touch-sensitive on/off key is being touched. The control system also includes two power controllers connected by a communication bus. When one of the power controllers initiates a lockout condition, the other power controller initiates a corresponding lockout condition. Multiple heating elements can be controlled together using a single set of control keys. A element size key toggles between different combinations of heating elements to control.

8 Claims, 3 Drawing Sheets

ELECTRIC COOKING RANGE HAVING MULTIPLE-ZONE POWER CONTROL SYSTEM AND WIPE RESISTANT CONTROL PANEL

BACKGROUND OF THE INVENTION

The present invention relates to the field of electronic controls and more specifically to an electronic power control system having touch-sensitive keys for controlling cooktop heating elements.

Conventional controls for electric cooktops utilize mechanical knobs for setting the power level of each of the heating elements. Recently, electronic controls have been increasing in popularity. Electronic controls are capable of providing a more precise level of heating. Further, associated digital controls are easier to read than an analog dial, allowing the quick setting of desired heat levels. Electronic controls are also capable of providing advanced features and flexible heating element control schemes that were more complicated, and often not possible, using traditional mechanical controls.

Modern electric cooktops often utilize so-called surface elements, wherein an electric heating element is provided beneath a flat glass cooking surface. The glass cooking surface makes it easier to clean the cooktop, since there are no cracks or crevices to cleans.

Modern electronic controls often utilize touch-sensitive or membrane style controls integrated into a glass cooktop or a separate flat control panel. Like the surface elements with glass cooktops, these generally flat controls are easier to clean than the conventional style knob controls. The controls may simply be wiped with a cloth or sponge to clean.

One drawback associated with touch-sensitive control keys is that they can easily be inadvertently activated when wiping the control surface during cleaning.

BRIEF SUMMARY OF THE INVENTION

According to a first aspect, the present invention provides a multiple-zone power control system for controlling power distribution to electric heating elements. The system comprises: a power control unit comprising a plurality of control zones for controlling the delivery of power to respective electric heating elements; and a touch-sensitive key for alternately activating and deactivating a designated one of the plurality of control zones when the touch-sensitive key is touched by a user. When all of the plurality of control zones are deactivated, the touch-sensitive key must be touched for at least a cold start duration in order to activate the designated one of the plurality of control zones, and when at least one of the plurality of control zones is activated, the touch-sensitive key must be touched for at least a minimum key-touch duration in order to activate the designated one of the plurality of control zones. The minimum key-touch duration is shorter than the cold start duration.

According to a second aspect, the present invention further provides a multiple-zone power control system for controlling power distribution to electric heating elements. The system comprises: a power control unit comprising a plurality of control zones for controlling the delivery of power to respective electric heating elements; a touch-sensitive on/off key for alternately activating and deactivating a designated one of the plurality of control zones when the touch-sensitive on/off key is touched by a user; and a touch-sensitive function key for controlling a function of the designated one of the plurality of control zones when the touch-sensitive function key is touched by a user. The designated one of the plurality of control zones is prevented from being activated if the touch-sensitive function key is touched while the touch-sensitive on/off key is being touched.

According to a third aspect, the present invention further provides a power control system for controlling power to electrical heating elements. The system comprises a communication bus; a first power controller for controlling power to a heating element of an oven, the first power controller being connected to the communication bus; a second power controller for controlling power to a heating element of a cooktop, the second power controller being connected to the communication bus; and a user interface controller for inputting and displaying control data for controlling the second power controller, the user interface controller being connected to the communication bus. When one of the first power controller and the second power controller initiates a lockout condition, the other one of the first power controller and the second power controller initiates a corresponding lockout condition in response to a lockout signal being provided on the communication bus.

According to a fourth aspect, the present invention further provides a cooktop for a cooking appliance. The cooktop comprises a first heating element; a second heating element at least partially surrounding the first heating element; a third heating element at least partially surrounding the second heating element; a power controller for selectively providing power at a selected level according to three operating modes, the three operating modes comprising: a first operating mode in which the power controller provides power at the selected level to the first heating element, a second operating mode in which the power controller simultaneously provides power at the selected level to the first heating element and the second heating element, and a third operating mode in which the power controller simultaneously provides power at the selected level to the first heating element, the second heating element and the third heating element; and a touch-sensitive mode selection key for selecting each of the three operating modes. The power controller selects a next one of the three operating modes according to a predetermined sequence each time the mode selection key is touched.

According to a fifth aspect, the present invention further provides a cooktop for a cooking appliance. The cooktop comprises: a first heating element; a second heating element; a third heating element; a first user interface controlling the first heating element individually in a first operating mode of the first user interface, controlling the first heating element and the second heating element together in a second operating mode, and the first heating element, the second heating element, and the third heating element together in a third operating mode; a second user interface controlling the third heating element individually in the first operating mode; and a touch-sensitive mode selection key provided to the first user interface for selecting each of the three operating modes. The first user interface selects a next one of the three operating modes according to a predetermined sequence each time the mode selection key is touched.

DETAILED DESCRIPTION OF THE INVENTION

Figure 1:
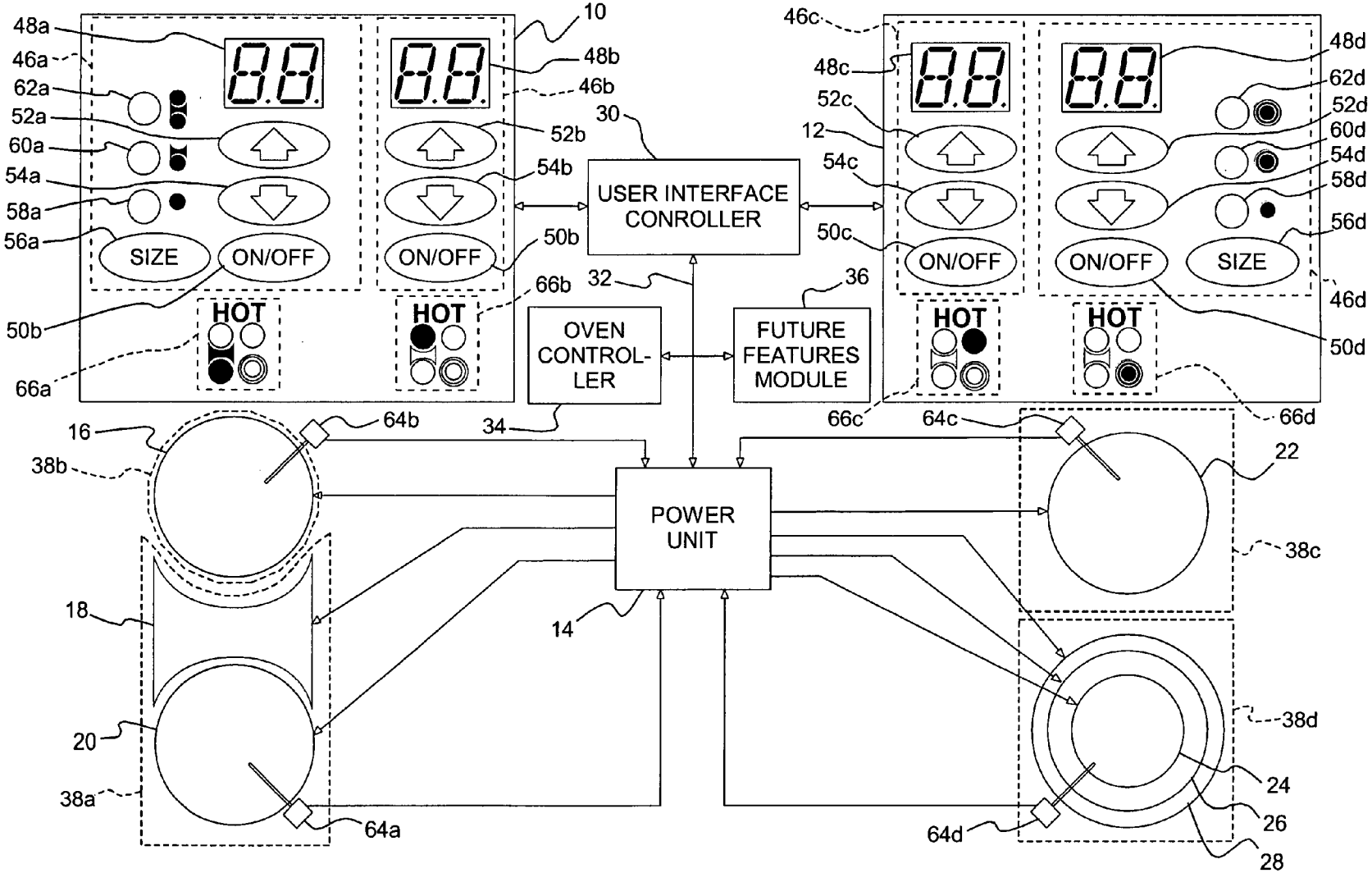
FIG. 1 is schematic diagram illustrating a multiple-zone power control system according to the present invention.

FIG. 1 illustrates a multiple-zone power control system according to an exemplary embodiment of the present invention. The power control system provides user interface panels 10, 12 for controlling the power distribution by a power unit 14 to a plurality of electric heating elements 16, 18, 20, 22, 24, 26, 28 for a cooktop of a domestic cooking range. A user interface controller 30 is connected to the power unit 14 via a communication bus 32. If the range includes an oven, such as with freestanding and slide in models, an oven controller 34 for controlling power distribution to an oven heating element (not shown) can also be connected to the communication bus 32. As a further option, an additional module 36, designated "future features module," can be connected to the communication bus 32 to provide for future expansion of the power control system to control additional components and accessories. Thus, each of the modules, including the user interface controller 30, the power unit 14, the oven controller 34, and the future features module 36, require only one connector in order to communicate with all of the other modules, simplifying the manufacturing process.

In the exemplary embodiment, the power control system is provided to a surface element-type cooktop having a glass top and the user interface panels 10, 12 include flush mounted touch sensitive-type controls. Each of the electric heating elements 16, 18, 20, 22, 24, 26, 28 is recessed below the glass top. This type of cooktop allows for easy cleanup, since the glass top and user interface panels 10, 12 have flat, smooth surfaces that can be wiped with a cloth or sponge.

The electric heating elements 16, 18, 20, 22, 24, 26, 28 are divided into heating zones for control by the user interface panels (10, 12). A first, "left front," or bridge heating zone 38*a* comprises a front heating element 20 and a bridge heating element 18. A second, or "left rear," heating zone 38*b* comprises only a rear heating element 16, being of substantially the same design as the front heating element 20. As described in more detail below, the bridge heating element 18 allows the first heating zone 38*a* and second heating zone 38*b* to be used together as a single, larger heating zone. A third, "right front," or triple element heating zone 38*c* comprises three concentrically arranged heating elements: an inner heating element 24*a* middle heating element 26 and an outer heating element 28, each element surrounding the next. As described in more detail below, the user can control the effective size of the third heating zone 38*c* by using one or more of its heating elements 24, 26, 28 in combination. A fourth, or "right rear," heating zone 38*d* comprises only a rear heating element 22, being of substantially the same design as the left front heating element 20 and the left rear heating element 16.

Each of the electric heating elements 16–28 is separately connected to the power unit 14 so that its power can be provided as required by the user interface controller 30. The power unit 14 can vary the level of power provided to each of the electric heating elements 16–28 by varying the duty cycle of a pulse-width modulated current, as is well known in the art. In the exemplary embodiment, the power unit 14 is configured to deliver twenty-five varying levels of power to each of the electric heating elements 16–28. Each of these power levels corresponds to a duty cycle, in terms of the percentage of the time that current is being delivered. An example of the correspondence between the twenty-five power levels and the duty cycle percent is shown in Table 1 below.

TABLE 1

| Power Level | Display | Duty Cycle % |
|---|---|---|
| 1 | Lo | 1 |
| 2 | 1.0 | 2 |
| 3 | 1.2 | 3 |
| 4 | 1.4 | 4 |
| 5 | 1.6 | 5 |
| 6 | 1.8 | 6 |
| 7 | 2.0 | 8 |
| 8 | 2.2 | 10 |
| 9 | 2.4 | 12 |
| 10 | 2.6 | 15 |
| 11 | 2.8 | 20 |
| 12 | 3.0 | 25 |
| 13 | 3.5 | 30 |
| 14 | 4.0 | 35 |
| 15 | 4.5 | 40 |
| 16 | 5.0 | 45 |
| 17 | 5.5 | 50 |
| 18 | 6.0 | 60 |
| 19 | 6.5 | 70 |
| 20 | 7.0 | 75 |
| 21 | 7.5 | 80 |
| 22 | 8.0 | 85 |
| 23 | 8.5 | 90 |
| 24 | 9.0 | 95 |
| 25 | Hi | 100 |

As used herein with reference to touch sensors, touch-sensitive keys, and the like, the term "touch" necessarily require actual contact of a sensor or key by an object. "Touch" refers generally to the object being placed in sufficient proximity to the sensor or key in order for the sensor or key to detect presence of the object, thereby activating sensor or key. An example of a touch sensor contemplated by the present invention is a capacitive or "field sensitive" sensor that senses the presence of a user's finger based on a change in capacitance or other electrical characteristic. These types of sensors, and other suitable touch sensors are known in the art. Alternatively, a known membrane switch assembly containing pressure sensitive switches can be used as the touch-sensitive keys according to the present invention. Further, other suitable types of user input devices can be used.

Each user interface panel 10, 12, as shown in FIG. 1, comprises two control zones 46*a*, 46*b*, 46*c*, 46*d*, for a total of four control zones 46*a*–46*d*, one corresponding to each heating zone 38*a*–38*d*. Each control zone 46*a*–46*d* includes a two-digit display 48*a*, 48*b*, 48*c*, 48*d*, a ON/OFF key 50*a*, 50*b*, 50*c*, 50*d* for toggling the control zone on and off, a slew-up key 52*a*, 52*b*, 52*c*, 52*d* for increasing the power level, and a slew-down key 54*a*, 54*b*, 54*c*, 54*d* for decreasing the power level.

Two of the control zones 46*a*, 46*d* are multi-element control zones since their respective heating zones 38*a*, 38*d* each include multiple heating elements. Each of these multi-element control zones 46*a*, 46*d* further include a SIZE button 56*a*, 56*d* for controlling the number of heating elements powered, and three indicator lights 58*a*, 60*a*, 62*a*, 58*d*, 60*d*, 62*d* for indicating the number of heating elements powered.

Each control zone 46*a*–46*d* is initially in an idle mode wherein the corresponding 2-digit display is blank and none of the heating elements 16–28 in the corresponding heating zone 38*a*–38*d* are being powered. In order to enter an active mode to provide power to a heating element 16–28, the user first touches a corresponding ON/OFF key 50*a*–50*d*, after which the corresponding 2-digit display 48*a*–48*d* begins flashing the digits "00". If a corresponding slew-up key 52*a*–52*d* or slew-down key 54*a*–54*d* is not touched with within a mode select timeout period, such as 5 seconds, then the control zone 46*a*–46*d* returns to the idle mode.

The active mode of each of the control zones 46*a*–46*d* will now be described. The term "simultaneously" is used herein to describe a condition is which two or more heating elements are activated together and power to each of the two or more heating elements is controlled using a single control zone. In this context, it is not necessary that powering of each of the two or more heating elements is initiated at exactly the same instant, or discontinued at exactly the same instant. With reference to the two single-element control zones 48*b*, 48*c*, if the user touches the corresponding slew-up key 52*b*, 52*c* within the mode select timeout period, the power level of the control zone 46*b*, 46*c* is set to the highest power level, the user interface controller instructs the power unit 14 to begin delivering power to the corresponding heating element 16, 22 at the highest power level, and, as indicated in Table 1 shown above, the corresponding two-digit display 48*b*, 48*c* displays "Hi." Likewise, if the user instead touches the corresponding slew-down key 54*b*, 54*c* within the mode select timeout period, the power level of the control zone 46*b*, 46*c* is set to the lowest power level, the user interface controller instructs the power unit 14 to begin delivering power to the corresponding heating element 16, 22 at the lowest power level and, as indicated in Table 1, the corresponding two-digit display 48*b*, 48*c* displays "Lo." For each subsequent touch of the slew-up key 52*b*, 52*c*, the user interface controller 30 increases the corresponding power level by one level, causing the corresponding two-digit display 48*b*, 48*c* to display the newly set power level as indicated in Table 1, and instructing the power unit 14 to provide power to the corresponding heating element 16, 22 at the appropriate duty cycle percent, as indicated in Table 1. Likewise, for each subsequent touch of the slew-down key 54*b*, 54*c*, the user interface controller 30 decreases the corresponding power level by one level, causing the corresponding two-digit display 48*b*, 48*c* to display the newly set power level as indicated in Table 1, and instructing the power unit 14 to provide power to the corresponding heating element 16, 22 at the appropriate duty cycle percent, as indicated in Table 1. If the ON/OFF key 50*b*, 50*c* is touched while the corresponding control zone 46*b*, 46*c* is in active mode, the control zone 46*b*, 46*c* is returned to idle mode and the user interface controller 30 causes the corresponding two-digit display 48*b*, 48*c* to turn blank and instructs the power unit 14 via the communication bus 32 to cease delivering power to the corresponding heating element 16, 22.

The multi-element control zones 48*a*, 48*d* function substantially as described above with respect to the single element control zones, with the exception of the following. After the ON/OFF key 50*a*, 50*d* is touched from idle mode, the first indicator light 58*a*, 58*d* begins flashing, indicating "power mode 1" will be entered upon selecting a power level. If the size key 56*a*, 56*d* is then touched, the second indicator light 60*a*, 60*d* begins flashing along with the first indicator light 58*a*, 58*d*, indicating "power mode 1" will be entered upon selecting a power level. For the triple element control zone 46*d*, if the size key 56*d* is touched a second time, the third indicator light 62*d* begins flashing along with the first indicator light 58*d*, and the second indicator light 60*d*, indicating that power "mode 3" will be entered upon selecting a power level. For the bridge element control zone 46*a*, if the size key 56*a* is touched a second time, the third indicator light 62*a* begins flashing along with the first indicator light 58*a*, and the second indicator light 60*a*, indicating that power "mode 4" will be entered upon selecting a power level. For both multi-element zones 46*a*, 46*d*, if the size key 56*a*, 56*d* is touched a third time, the control zone 46*a*, 46*d* returns to indicating "power mode 1." Once the slew-up 52*a*, 52*d* key or the slew-down key 54*a*, 54*d* is touched, the control zone 46*a*, 46*d* enters the active mode, providing power to the appropriate heating elements 16–20, 24–28.

For the triple element control zone 46*d*, entering active power mode 1 causes the power unit 14 to supply power to the inner heating element 24 at the selected power level. Power mode 2 causes the power unit 14 to supply power to both the inner heating element 24 and the middle heating element 26 at the selected power level. Entering active power mode 3 causes the power unit 14 to supply power to all three of the inner heating element 24, the middle heating element 26, and the outer heating element 28 at the selected power level. If the ON/OFF key 50*d* is touched while the triple element control zone 46*d* is in active mode, the control zone 46*d* is returned to idle mode and the user interface controller 30 causes the corresponding two-digit display 48*d* to turn blank and instructs the power unit 14 via the communication bus 32 to cease delivering power to any of the heating elements 24–28 that were being powered.

For the bridge element control zone 46*a*, entering active power mode 1 causes the power unit 14 to supply power to the front heating element 20 at the selected power level. Power mode 2 causes the power unit 14 to supply power to both the front heating element 20 and the bridge heating element 18 at the selected power level. Entering active power mode 4 causes the two left heating zones 38*a*, 38*b* to be controlled in unison by the bridge element control zone 46*a*. During power mode 4, the single element control zone 46*b* corresponding to the left rear heating zone 38*b* is disabled. 1. If the ON/OFF key 50*a* is touched while the bridge element control zone 46*a* is in active mode 1 or 2, the control zone 46*a* is returned to idle mode and the user interface controller 30 causes the corresponding two-digit display 48*a* to turn blank and instructs the power unit 14 via the communication bus 32 to cease delivering power to any of the heating elements 18, 20 that were being powered by the bridge-element control zone. If the ON/OFF key 50*a* is touched while the bridge element control zone 46*a* is in active mode 4, the control zone 46*a* is returned to idle mode and the user interface controller 30 causes the corresponding two-digit display 48*a* to turn blank and instructs the power unit 14 via the communication bus 32 to cease delivering power to the heating elements 16–20.

As described above, two zones, the bridge heating zone 38*a* and the left rear heating zone 38*b*, are linked together in a linked mode, mode 4, so that when the power level is changed in one of the zones 38*a*, 38*b*, the power level is correspondingly changed in the other. It is also contemplated that three or more cooking zones can be linked in this manner according to the present invention.

Further, each of the heating zones 38*a*–38*d* of the cooktop includes a thermal limiter assembly 64*a*, 64*b*, 64*c*, 64*d* connected to the power unit 14. Each of the thermal limiter assemblies 64*a*–64*d* includes an upper temperature limit sensor and a lower temperature limit or "hot-surface" sensor. In the exemplary embodiment, bi-metal thermostatic switches provided on the heating elements 16, 20–28 are used as the upper temperature limit sensors and the hot-surface sensors. When the power unit 14 receives a hot-surface signal from one of the thermal limiter assemblies 64*a*–64*d*, indicating that the corresponding heating zone 38*a*–38*d* is at or above a lower temperature limit, the power unit 14 instructs the user interface controller 30, via the communication bus 32, to illuminate a corresponding hot surface indicator 66*a*, 66*b*, 66*c*, 66*d* provided on the corresponding user interface panel 10, 12. The hot surface indicator 66*a*–66*d* informs the user that the corresponding heating zone 46*a*–46*d* is hot, having reached the lower temperature limit, such as about 50 to 70° C. In an exemplary embodiment, the hot surface indicators 66*a*–66*d* appear as text and/or graphics that blends with the color of the glass top covering the heating elements 16–28 or the glass surface of the user interface panels 10, 12. The indicators 66*a*–66*d* include LEDs (light emitting diodes) that light up behind the glass when the corresponding heating zone 38*a*–38*d* reaches the lower temperature limit making the hot surface indicators 66*a*–66*d* visible.

When the power unit 14 receives a high temperature signal from one of the thermal limiter assemblies 64*a*–64*d*, indicating that the corresponding heating zone 46*a*–46*d* is at or above an upper temperature limit, the power unit 14 prevents power from being transmitted to the heating element(s) 16–28 in that heating zone 38*a*–38*d* until the temperature drops and the high temperature signal ceases. An appropriate upper temperature limit, such as 500° C., is chosen to prevent the glass top covering the heating elements 16–28 from being damaged. Other suitable temperatures can be used from the lower temperature limit and the upper temperature limit, as appropriate.

Figure 2A:
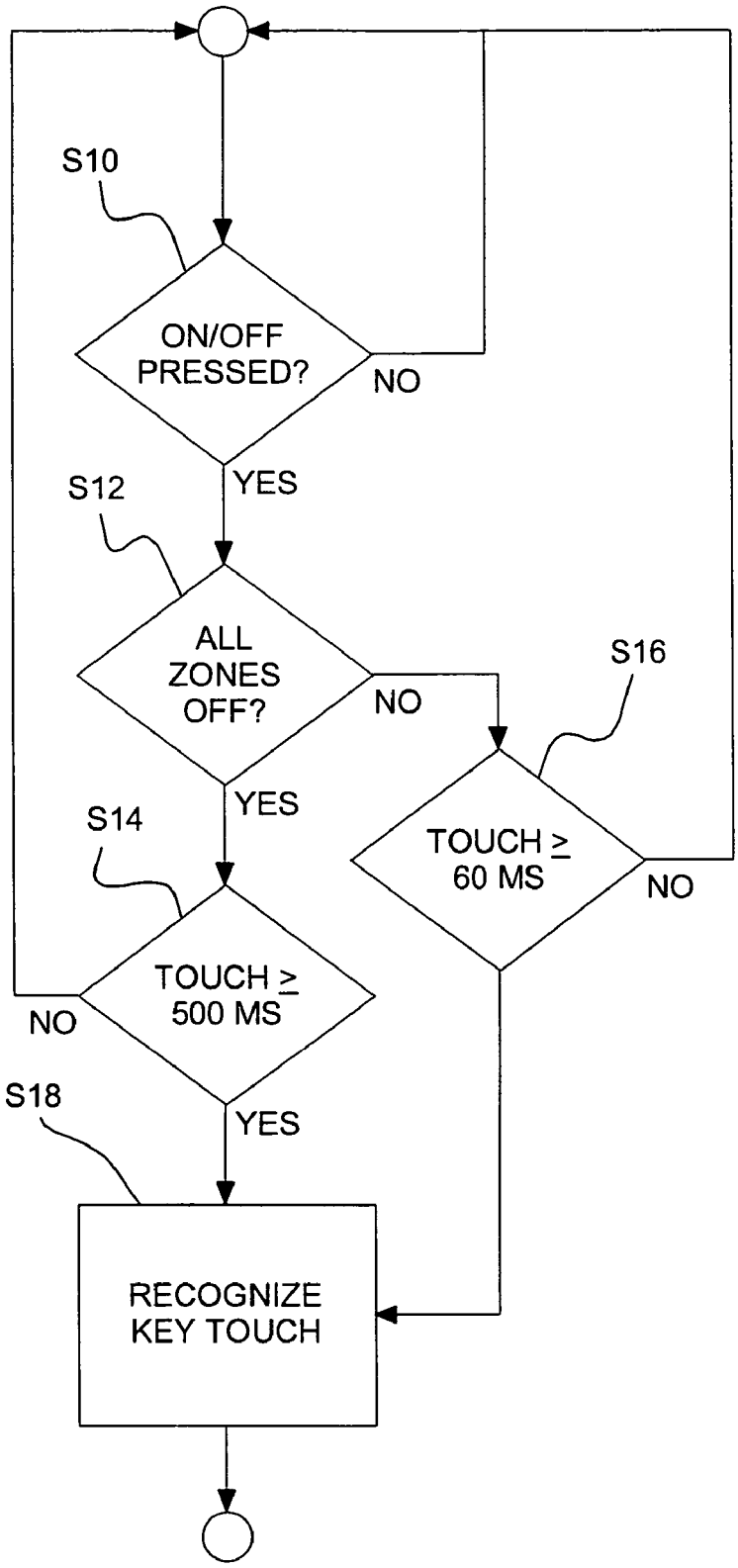
FIGS. 2A and 2B are flow diagrams illustrating a wipe protection method for a user interface panel according the present invention.
Figure 2B:
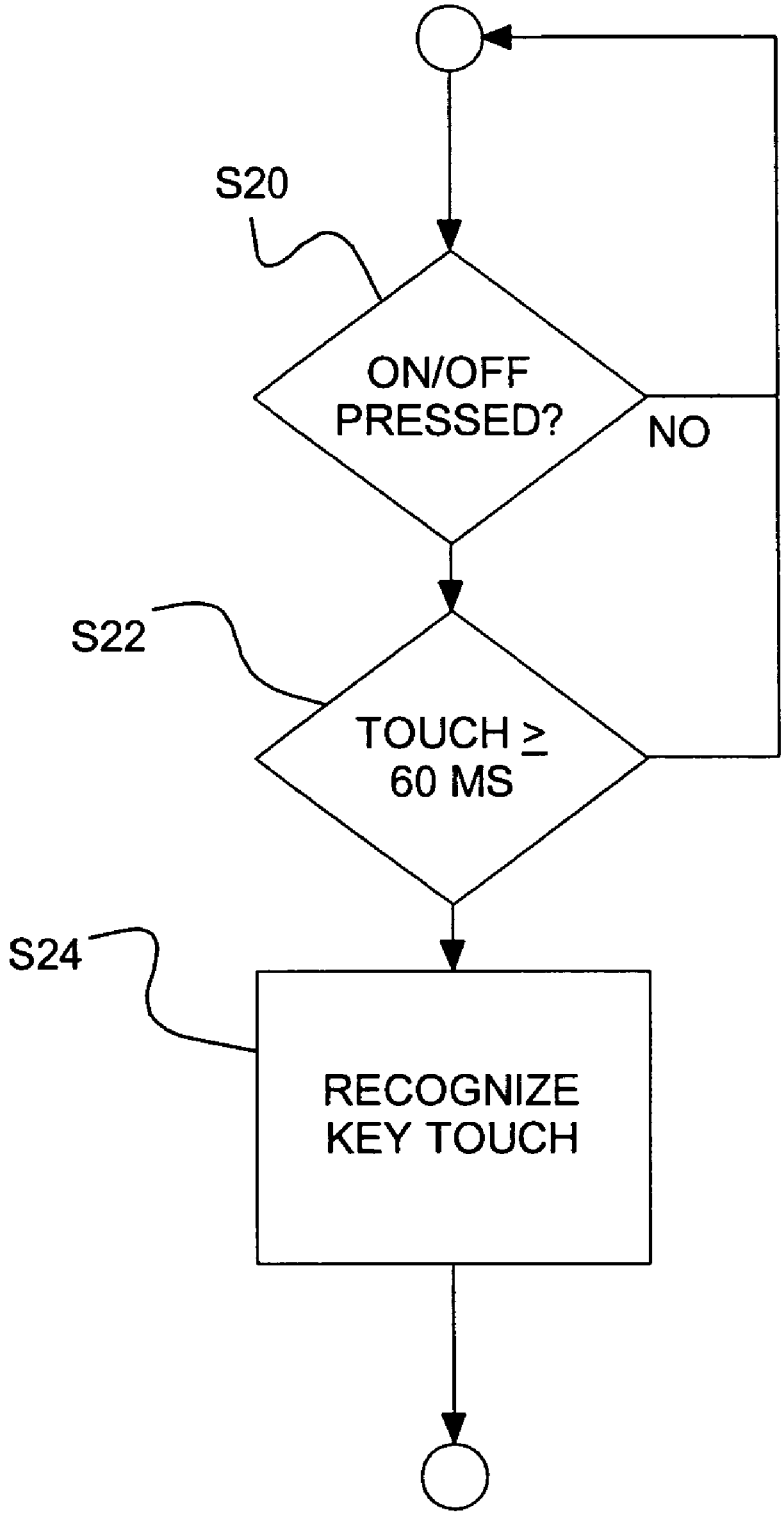

During the cleaning of the touch-sensitive user interface panels 10, 12, such as by wiping them with a cloth or sponge, the touch-sensitive key can be inadvertently activated. Therefore, as illustrated in FIGS. 2A and 2B, in order to reduce the likelihood of inadvertently activating one or more of the heating elements 16–28 during cleaning, the following wipe-protection method is implemented in the exemplary embodiment of the present invention. The terms "cold start" as used herein refer to the operation of activating a control zone when the power control unit 14 is in a condition in which the none of the control zones 46*a*–46*d* are in the active mode. Thus, the use of the word "cold" in this context does not relate in any way to temperature.

As shown schematically in FIG. 2A, when all of the control zones 46*a*–46*d* of the control system of the present invention are in idle mode, the ON/OFF 50*a*–50*d* key must be touched for a longer period of time, referred to as a "cold start duration," in order to be recognized by the user interface controller 30 to begin the process of entering the active mode described above. In the exemplary embodiment, the cold start duration is 500 milliseconds. Otherwise, if one or more of the other control zones 46*a*–46*d* is already in active mode, the ON/OFF 50*a*–50*d* key need only be touched for a minimum key-touch duration to be recognized. In the exemplary embodiment, the minimum key-touch period is 60 milliseconds. With reference to FIG. 2A, at step S10, when it is detected that an ON/OFF key 50*a*–50*d* has been touched, the user interface controller 30 proceeds to step S12. At step S12, if all of the control zones 46*a*–46*d* are in idle mode, then, at step S14 the key touch is only recognized (S18) if the ON/OFF key 50*a*–50*d* has been touched for 500 milliseconds or more. If, however, at step S12, one or more of the control zones 46*a*–46*d* is in active mode, then, at step S16 the key touch is recognized (S18) if the ON/OFF key 50*a*–50*d* has been touched for 60 milliseconds or more. Thus, when wiping the user interface panels 10, 12 with all of the control zones 46*a*–46*d* idle, the ON/OFF key 50*a*–50*d* is not easily pressed. Alternatively, for additional resistance to wiping of the ON/OFF key 50*a*–50*d*, the minimum key-touch period could be increased, such as to 200 milliseconds.

As shown in FIG. 2B, when a control zone 46*a*–46*d* is in active mode, its ON/OFF key 50*a*–50*d* need only be touched for the minimum key-touch duration in order to cause the control zone 46*a*–46*d* to enter the idle mode, turning off its respective heating element(s) 16–28. At step 20, when it is detected that the ON/OFF key 50*a*–50*d* has been touched, the user interface controller 30 proceeds to step S22. At step S22, if the ON/OFF key 50*a*–50*d* has been touched for at least 60 milliseconds, the key touch is recognized by the user interface controller 30 and power to the corresponding heating zone 38*a*–38*d* is discontinued. Thus, when wiping the user interface panels 10, 12 with one or more of the control zones 46*a*–46*d* in active mode, the ON/OFF key 50*a*–50*d* of the active control zone(s) 46*a*–46*d* is easily pressed, initiating idle mode. One of ordinary skill in the art will recognize that the cold start duration and minimum key-touch duration can set to any appropriate values without departing from the present invention, so long as the cold start duration is greater than the minimum key-touch duration.

Alternatively, or along with the wipe-protection method of FIGS. 2A and 2B, a further technique is disclosed, according to the present invention, for reducing the false initiation of one or more of the control zones 46*a*–46*d* during cleaning by preventing a control zone from entering the active mode when multiple keys are touched together. Such multiple key activation can often occur when a broad instrument, such as a sponge or a cloth, is used to wipe the user interface panel. Specifically, according to the present invention, for the purpose of initiating entry into the active mode, the user interface controller will not recognize that an ON/OFF key has been touched, if during the touching of the ON/OFF key, it is detected that one or more of the other control keys, such as the slew-up key, the slew-down key or the size key, has been touched. In order to allow two control zones to be activated simultaneously, this rule can be modified slightly. For example, in one variation, the user interface will not recognize that an ON/OFF key has been touched if, during the touching of the ON/OFF key, it is detected that one or more of the other control keys in the same control zone has been touched. According to other possible variations, the user interface will not recognize that an ON/OFF key has been touched if, during the touching of the ON/OFF key, it is detected that one or more of the other control keys located within a certain proximity to the ON/OFF key or within a common geometric region or group as the ON/OFF key has been touched.

As briefly mentioned above, an oven controller 34 may be connected to the communication bus 32. In the exemplary embodiment, the communication bus 32 is a single-wire serial communication bus. The communication bus utilizes only a single data conductor; however, each module connected to the single-wire communication bus is also referenced to a common ground, a common supply voltage, and/or additional common connection. Examples of a known single-wire serial communication buses are the LIN standard available from the Lin Consortium, and the ISO-9141 standard available from the International Organization for Standardization. Other suitable type of communication buses may also be used.

The connection of the oven controller to the communication bus 32 allows the oven controller 34 to communicate with the other modules, including the user interface controller 30. This allows coordinated functioning between the cooktop's user interface controller 30 and the oven controller 34. For instance, one of the modules can lockout the operation of another.

In the exemplary embodiment, when a cleaning cycle of the oven is initiated, the oven controller 34 initiates a lockout condition and sends a lockout signal to the communication bus 32. When the user interface controller 30 detects the lockout signal, the heating zones 38*a*–38*d* are prevented from being powered. Similarly, when the cooktop is being operated, such as when any of the control zones 46*a*–46*d* are in active mode, the user interface controller 30 sends a lockout signal to the communication bus 32, preventing the oven controller 34 from initiating a cleaning cycle. Further, a user-initiated lockout condition can optionally be provided, wherein the user initiates a total lockout of the range, including the cooktop and oven, by activating a lockout key or a combination of keys provided on the range. During any of the above-mentioned lockout conditions, a visual indication of the lockout can be communicated to the user via one or more of the two-digit displays 48*a*–48*d*. In the exemplary embodiment, the user interfaces 10, 12, display "--" . on each of their two-digit displays 48*a*–48*d* during a lockout.

The communication bus 32 also allows for errors to be detected and diagnostics to be performed. Each of the modules connected to the communication bus 32, including the power unit 14, the user interface controller 30, and the oven controller 34, is either a communication master or a communication slave. Only one of the modules is configured as a communication master. In the exemplary embodiment, the over controller 34 is the communication master. The communication master, the oven controller 34, ask the slaves, the user interface controller 30 and the power unit 14, for status. The slaves respond by indicating their status, such as idle mode, active mode, and the like. If one of the slaves indicates a lockout condition, the oven controller 34 instructs all of the necessary modules to enter the lockout condition. If one of the slaves indicates a communications failure, such as the failure of the user interface controller 30 to communicate with one or both of the user interface panels 10, 12, the oven controller 34 instructs all of the necessary modules to enter an error mode, wherein operation is prevented and an error message is displayed. A port for external connection can be provided to the oven controller 34, allowing an external tool to be connected, such as for reporting the status of the modules on the communication bus 32 to a laptop PC or other device.

Further, the exemplary embodiment of the present invention includes a demonstration or test mode. The test mode can be used to perform tests of the touch-sensitive keys 50*a*–50*d*, 52*a*–52*d*, 54*a*–54*d*, 56*a*, 56*d*, the indicators 58*a*, 58*d*, 60*a*, 60*d*, 62*a*, 62*d*, 66*a*–66*d*, and the displays 48*a*–48*d* on the user interface panels 10, 12. It may be used, for example, at time of manufacture or installation, for a sales floor demonstration, or for field service, as an aid for testing and demonstrating the operation of the range.

In the exemplary embodiment, the test mode is initiated at the user interface panels 10, 12 by touching both the left front slew-up key 52*a* and right front slew-up key 52*d* continuously for five seconds. Then, if no communication failure is detected, the user interface controller 30 will attempt to enter the test mode by sending a test mode request signal to the communications bus 32. The test mode may also be initiated by the oven controller 34 in a similar fashion using an oven user interface (not shown). While in test mode, the test mode requester, either the user interface controller 30 or the oven controller 34 in the exemplary embodiment, will continuously transmit a test mode request signal. All other modules connected to the communication bus 34 will continuously respond with a test mode acknowledge signal. If one or more modules fail to acknowledge the test mode by transmitting a test mode acknowledge signal, or if the test mode requester stops transmitting the test mode request signal for a designated time, such as 250 milliseconds, the test mode is exited and a failure mode is entered.

Initially, the user interface panels 10, 12 and user interface controller 30 respond to the test mode signal by testing their outputs as follows. Each of the two-digit displays 48*a*–48*d* display the decimal point in the right digit until test mode is exited. Initially, the two-digit displays 48*a*–48*d* light up half of the their segments, referred to as odd-numbered segments, for 3 seconds and then light up the other half of their segments, referred to as even-numbered segments, for 3 seconds. At the same time, the front hot surface indicators (66*a*, 66*d*) light up for 3 seconds and then the rear hot surface indicators light up for 3 seconds. Also at the same time, the bottom element size indicator lights 58*a*, 58*d* light up for 2 seconds, then the middle element size indicator lights 60*a*, 60*d* light up for 2 seconds, and finally the top element size indicator lights 62*a*, 62*d* light up for 2 seconds.

After the output testing is complete, the test mode proceeds. In the test mode, the two-digit displays 48*a*–48*d* and the element size indicator lights 58*a*, 60*a*, 62*a*, 58*d*, 60*d*, 62*d* behave normally in response to the operation of the touch-sensitive keys 50*a*–50*d*, 52*a*–52*d*, 54*a*–54*d*, 56*a*, 56*d*, except that the decimal point of the right digit remains lit on the two-digit displays 48*a*–48*d* and the power unit 14 does not deliver power to the heating elements 16–28. Also, during the test mode, the hot surface indicators 66*a*–66*d* turn on in response to the corresponding control zone 46*a*–46*d* being placed in a test version of the active mode. Once turned on, each of the hot surface indicators 66*a*–66*d* remains lit until five seconds after the corresponding control zone 46*a*–46*d* is returned to a test version of the idle mode. This allows the user to test the operation of each of the keys and operating modes. All of the heating elements 16–28 remain off at all times during the demo mode. Touching both the left front slew-up key 52*a* and the right front slew-up key 52*d* for five seconds exits the test mode, and the user interface controller 30 returns all of the control zones 46*a*–46*d* to the idle mode. Other test functions and modes may be provided as necessary.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

The invention claimed is:

1. A multiple-zone power control system for controlling power distribution to electric heating elements, the system comprising:

a power control unit comprising a plurality of control zones for controlling the delivery of power to respective electric heating elements; and a touch-sensitive key for alternately activating and deactivating a designated one of the plurality of control zones when the touch-sensitive key is touched by a user;

the system has a configuration such that when all of the plurality of control zones are deactivated, the touch-sensitive key must be touched for at least a predetermined first time period in order to activate the designated one of the plurality of control zones; and the system has a configuration such that when at least one of the plurality of control zones is activated, the touch-sensitive key must be touched for at least a minimum key-touch duration predetermined second time period in order to activate the designated one of the plurality of control zones, the second time period being shorter than the first time period.

2. The system of claim 1, wherein the system has a configuration such that when the designated one of the plurality of control zones is activated, the designated one of the plurality of control zones will always be deactivated when the touch-sensitive key is touched for at least a predetermined third time period, the third time period being shorter than the first time period.

3. A multiple-zone power control system for controlling power distribution to electric heating elements, the system comprising:

a power control unit comprising a plurality of control zones for controlling the delivery of power to respective electric heating elements; and a touch-sensitive key for alternately controlling activation and deactivation of a designated one of the plurality of control zones responsive to touch by a user to the touch-sensitive key;

means for determining touch duration on the touch-sensitive key;

means for determining if all of the plurality of control zones are deactivated;

means for preventing activation of the designated one of the plurality of control zones, when the plurality of control zones are deactivated, upon touch of the touch-sensitive key until the touch duration exceeds a predetermined first time period;

means for determining if at least one of the plurality of control zones is activated; and means for preventing activation of the designated one of the plurality of control zones, when at least one of the plurality of control zones is activated, upon touch of the touch-sensitive key until the touch duration exceeds a predetermined second time period, the second time period being shorter than the first time period.

4. The system of claim 3, including means for maintaining an association of the touch-sensitive key to control deactivation of the designated one of the plurality of control zones when the designated one of the plurality of control zones is activated, and means for preventing deactivation of the designated one of the plurality of control zones, when the designated one of the plurality of control zones is activated, upon touch of the touch-sensitive key until the touch duration exceeds a predetermined third time period, the third time period being shorter than the first time period.

5. A method of reducing inadvertent power activation during a wiping/cleaning operation of a touch-sensitive power control input panel, comprising steps of:

sensing that a touch-sensitive on/off key has been touched by a user;

after the step of sensing, activating a power control zone that corresponds to the touch-sensitive on/off key when at least one other power control zone is activated and the on/off key remains touched for at least a first predetermined key-touch duration; and after the step of sensing, activating a power control zone that corresponds to the touch-sensitive on/off key when the on/off key remains touched for at least a cold start duration, the predetermined key-touch duration being shorter than the cold start duration.

6. The method of claim 5, further comprising a step of, after the step of sensing, deactivating the power control zone that corresponds to the touch-sensitive on/off key if the power control zone that corresponds to the touch-sensitive on/off key is activated and the on/off key remains touched for at least a second predetermined key-touch duration.

7. A method of reducing inadvertent power activation of a multiple-zone power control system that controls power distribution to electric heating elements and that has a power control unit having a plurality of control zones for controlling the delivery of power to respective electric heating elements, and a touch-sensitive key for alternately controlling activation and deactivation of a designated one of the plurality of control zones responsive to touch by a user to the touch-sensitive key, the method comprising steps of:

determining touch duration on the touch-sensitive key;

determining if all of the plurality of control zones are deactivated;

preventing activation of the designated one of the plurality of control zones, when the plurality of control zones are deactivated, upon touch of the touch-sensitive key until the touch duration exceeds a predetermined first time period;

determining if at least one of the plurality of control zones is activated; and preventing activation of the designated one of the plurality of control zones, when at least one of the plurality of control zones is activated, upon touch of the touch-sensitive key until the touch duration exceeds a predetermined second time period, the second time period being shorter than the first time period.

8. The method of claim 7, further comprising maintaining an association of the touch-sensitive key to control deactivation of the designated one of the plurality of control zones when the designated one of the plurality of control zones is activated, and preventing deactivation of the designated one of the plurality of control zones, when the designated one of the plurality of control zones is activated, upon touch of the touch-sensitive key until the touch duration exceeds a predetermined third time period, the third time period being shorter than the first time period.

* * * * *

UNITED STATES PATENT AND TRADEMARK OFFICE

CERTIFICATE OF CORRECTION

PATENT NO. : 7,022,949 B2
APPLICATION NO. : 10/822456
DATED : April 4, 2006
INVENTOR(S) : Sanjay Shukla It is certified that error appears in the above-identified patent and that said Letters Patent is hereby corrected as shown below:

On The Title Page, Item (75)
Please add second inventor --Gary W. Fisher, Goodlettsville, TN (US)
In Column 3, line 49, please delete "24*a*" and insert --24 a--

Signed and Sealed this

Twelfth Day of December, 2006

JON W. DUDAS
*Director of the United States Patent and Trademark Office*